United States Patent [19]

Hansen et al.

[11] 4,135,379

[45] Jan. 23, 1979

[54] PORTABLE HEAD FOR ELECTROMAGNETIC PULLING

[75] Inventors: Karl A. Hansen; I. Glen Hendrickson, both of Seattle, Wash.

[73] Assignee: Boeing Commercial Airplane Company, Seattle, Wash.

[21] Appl. No.: 726,872

[22] Filed: Sep. 27, 1976

[51] Int. Cl.[2] ..... B21D 26/02

[52] U.S. Cl. ..... 72/56; 29/421 M; 72/DIG. 30

[58] Field of Search ..... 72/56, DIG. 26; 29/421 M; 361/143

[56] References Cited

U.S. PATENT DOCUMENTS

| | | | |
|---|---|---|---|
| 3,126,046 | 3/1964 | Richey | 72/56 |
| 3,703,958 | 11/1972 | Kolm | 361/143 X |
| 3,800,643 | 4/1974 | Scott | 83/171 X |
| 3,998,081 | 12/1976 | Hansen et al. | 29/421 M |

OTHER PUBLICATIONS

"Electrohydraulic Forming" Machinery, Sep. 1963, by R. J. Schwingharmer.

"Magnetform" by General Dynamics, p. 122, May 29, 1962.

*Primary Examiner*—Leon Gilden

*Attorney, Agent, or Firm*—Bernard A. Donahue; Morris A. Case

[57] ABSTRACT

An adjustable regulator and a cycle initiating firing pin are mounted in the handle of a casing which contains a flux concentrator. The adjustable regulator sets the amplitude of current from a control panel to the flux concentrator through a flexible multi-conductor cable. The flux concentrator is separately encased and detachably mounted to the casing.

7 Claims, 10 Drawing Figures

Fig. 1
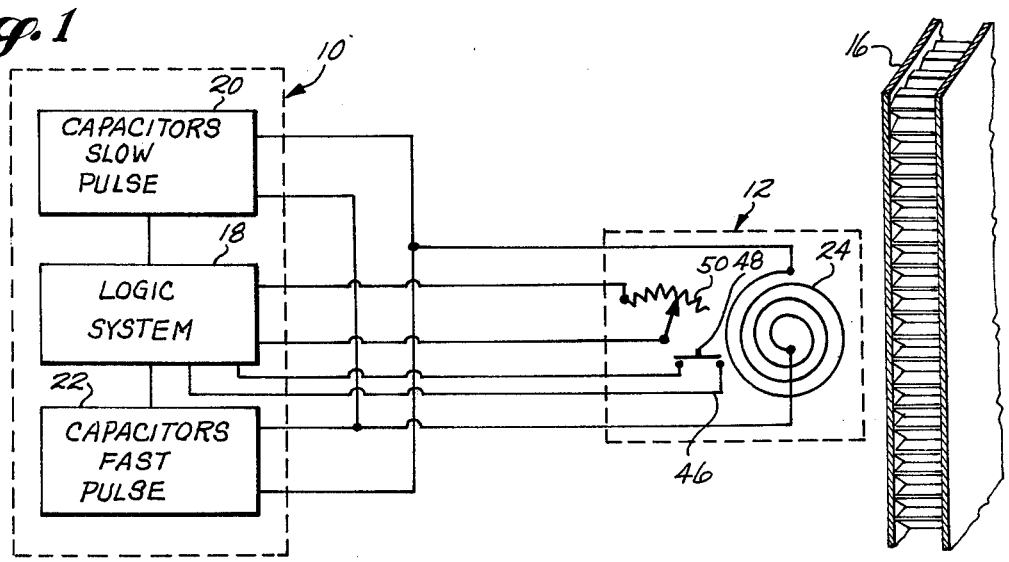
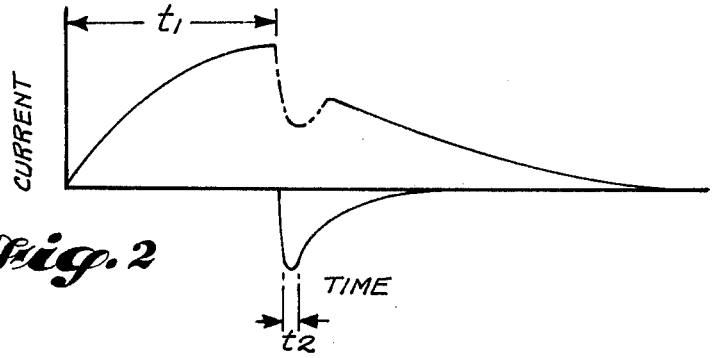
Fig. 2
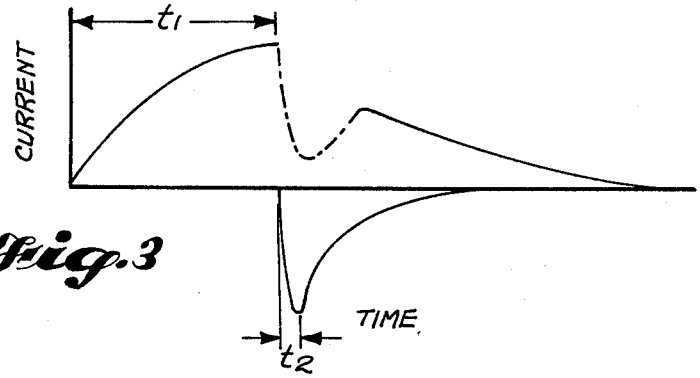
Fig. 3

PORTABLE HEAD FOR ELECTROMAGNETIC PULLING

RELATIONSHIP TO OTHER APPLICATIONS

This application is related to application Ser. No. 489,290, now U.S. Pat. No. 3,998,081 filed July 17, 1974, entitled ELECTROMAGNETIC DENT PULLER: and to follow an application Ser. No. 646,068, filed Jan. 2, 1976, now U.S. Pat. No. 4,061,007 entitled ELECTROMAGNETIC DENT REMOVER WITH ELECTROMAGNETIC LOCALIZED WORK COIL, both by the inventors named herein. The benefit of the filing date of this application is claimed under 35 USC 120.

BACKGROUND OF THE INVENTION

Electromagnetic forming of conductive material has been known for some time wherein a rapid pulsed current is passed through a coil to set up electromagnetic forces. These forces deform the metal in the conductive material into a recess or mold by a pushing force moving the coil and the conductive material apart. A working head containing the coil is held in place by a boom, the head is fastened down, or the head is heavy enough to hold the coil in proper position with respect to the article to be formed. A firing pin is the only control located in the working head. In application Ser. No. 489,290, an electromagnetic puller for a conductive material was disclosed wherein a coil was first energized with a high amplitude current to set up a repulsing electromagnetic field slow pulsed to prevent deforming the conductive material which was followed by a lower amplitude fast pulsed current to collapse the first field and set up an electromagnetic flux which pulled the coil and a part to be formed together with a force sufficient to remove dents. That application also disclosed several coils shaped to act as flux concentrators to direct the electromagnetic forces to the desired area. In application Ser. No. 646,068 other coils were disclosed which were shaped to act as flux concentrators. In application Ser. No. 489,290 a head was shown which was supported by a supporting arm, however, it was noted the head may be portable. It was discovered that a portable head may be used which has current amplitude control right in the head.

SUMMARY OF THE INVENTION

A portable head has a flux concentrator embedded in a non-conductive material that is removably attached to a snout shaped casing to permit rapid change. The casing has a handle with an adjustable control to set the amplitude of current flow to the flux concentrator, and also a firing button to initiate a pulling cycle at the portable head. A multiconductor flexible cable leading from a control panel transmits control signals from the amplitude control dial and from the firing button to the control panel and also transmit the controlled flow of current to the flux concentrator. A hose is also located in the cable to supply air from an air compressor to passages within the casing to furnish cooling air to the flux concentrator.

It is an object of this invention to provide a portable head for electromagnetic pulling that has a replaceable flux concentrator.

It is another object to provide a portable head for electromagnetic pulling that has controls located in the head.

DESCRIPTIONS OF THE DRAWINGS

FIG. 1 shows a block diagram of the electrical circuit for the apparatus along with a fragmented perspective of a part to be pulled.

FIG. 2 is a diagram showing the amplitude and time relationship of the combined slow and fast pulses of current through a flux concentrator.

FIG. 3 is a diagram as in FIG. 2 with a different relationship between the two currents.

DETAILED DESCRIPTION

Figure 4:
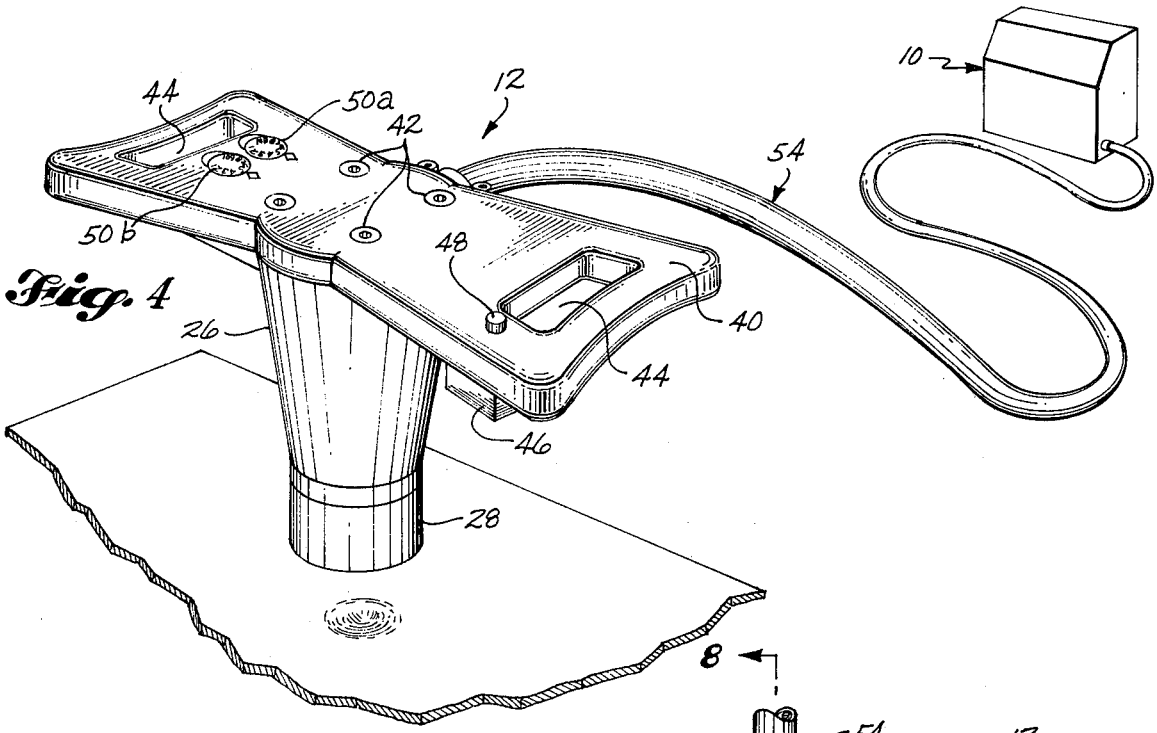
FIG. 4 shows a perspective view of the portable head, with control panel, of this invention with a dented fragmented part.

In electromagnetic pulling, a control panel 10 has the controls for operation of a portable head 12, which is used to pull on conductive material or part 16. Within the control panel is a logic system 18, which is set to first initiate a high amplitude slowly rising pulse of current from capacitors 20. At the proper time, the logic system initiates a second rapid rising lower amplitude pulse of current, from capacitors 22, which is 180° out of phase with the first slowly rising current. These pulses of current are carried to a flux concentrator 24 where the first slowly rising pulse sets up a high intensity field which is collapsed back toward the concentrator with the arrival of the second opposing fast pulse of current.

Figure 8:
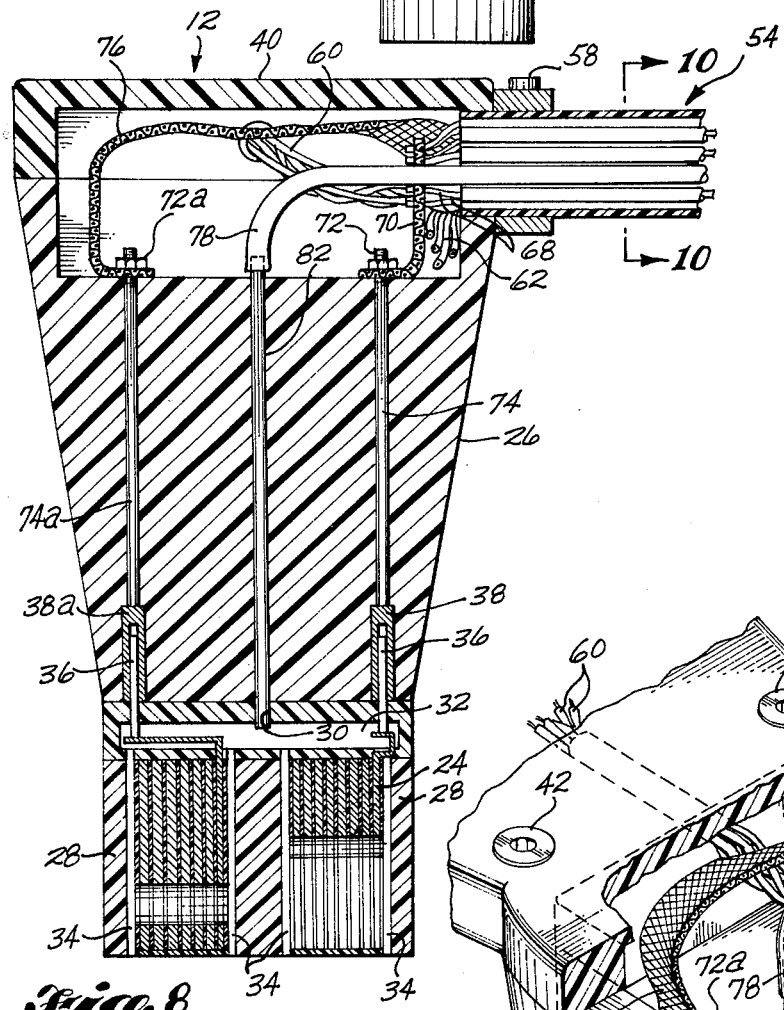
FIG. 8 shows a fragmented side elevation sectional view taken along lines 8—8 of FIG. 5.
Figure 9:
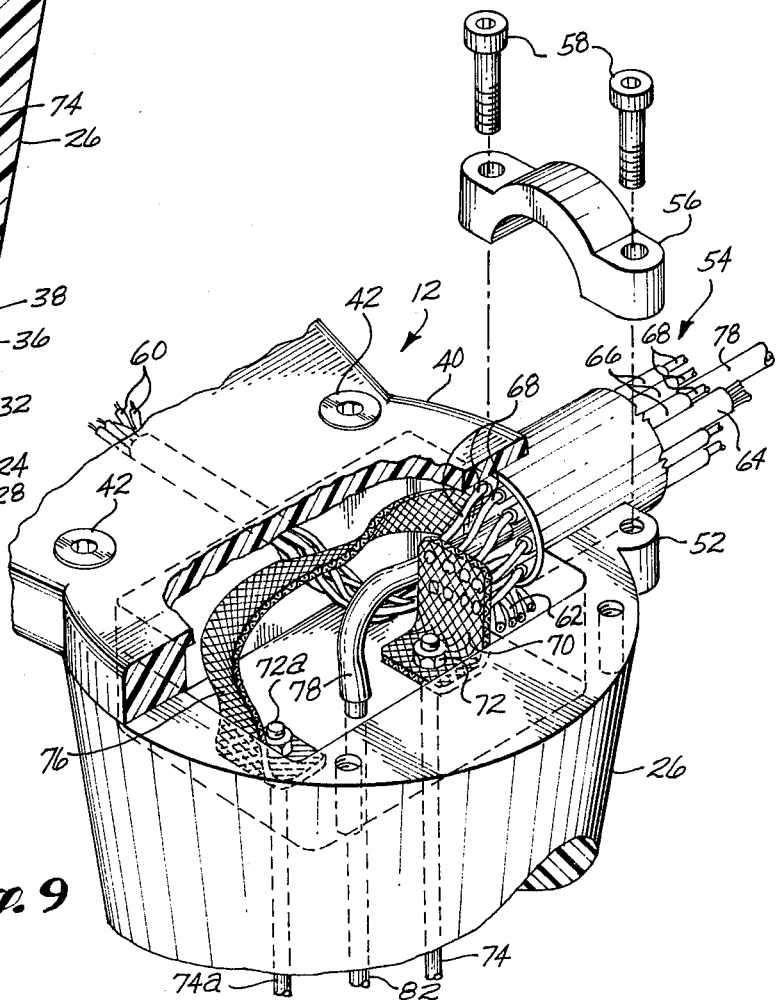
FIG. 9 is a fragmented perspective view of the portable head of this invention partially cut away to show a different view of the internal wiring of FIG. 8.

The portable head 12, the details of which are shown in FIGS. 4 through 10, has a snout or casing member 26. The flux concentrator 24 may be embedded in the snout, but preferably is detachably mounted as is shown in these figures. The flux concentrator which is best shown in FIG. 8, is of the type shown in application Ser. No. 646,068; however, it is not intended to limit it to that configuration, as other types of flux concentrators may be used. The flux concentrator 24 is encased 28 in a non-conductive material which has opening 30, header 32 and a plurality of passages 34. A pair of rigid connector terminals 36 extend into a pair of conductive sockets 38 and **38*a* located in the casing 26**. The terminals and sockets are sized to give a tight fit to hold the encased flux concentrator to the casing while allowing easy removal and easy replacement by plugging in a new flux concentrator having the same or different characteristics.

Figure 5:
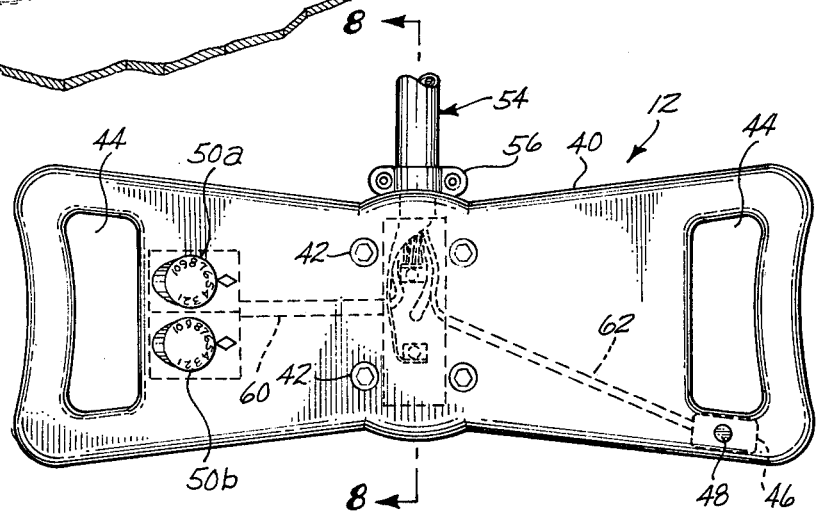
FIG. 5 shows a fragmented plan view of the portable head of FIG. 4.
Figure 6:
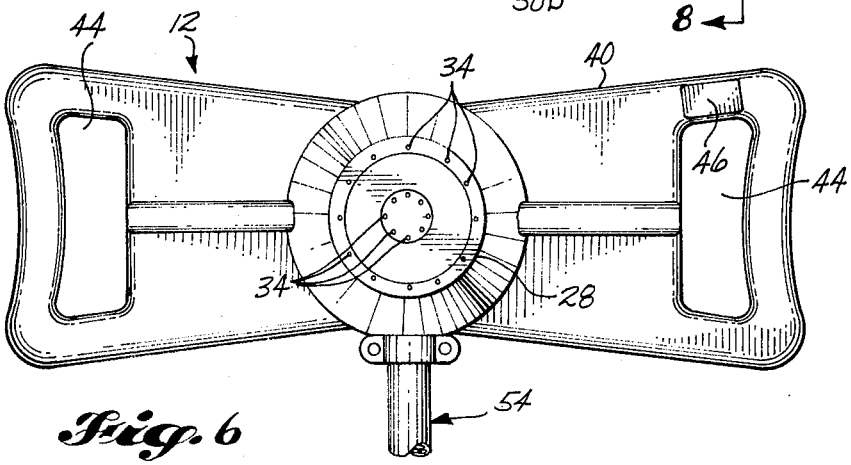
FIG. 6 shows a fragmented view of the portable head of FIG. 4 as seen from below.
Figure 7:
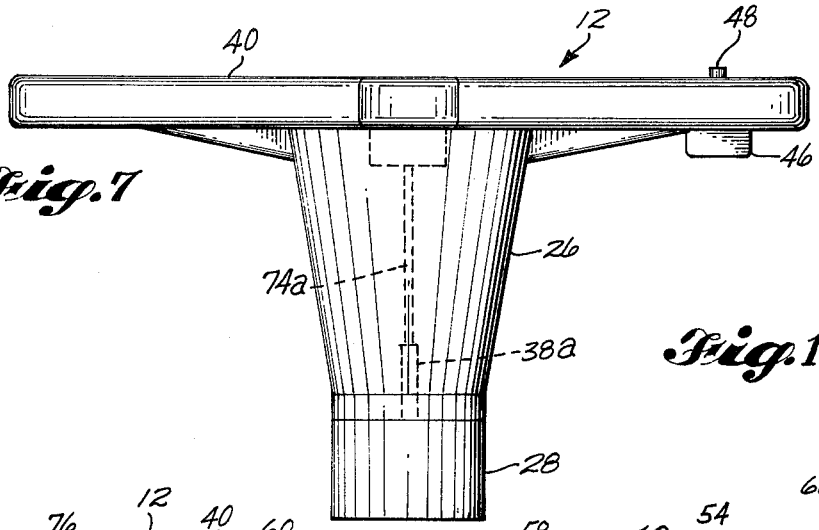
FIG. 7 is a side elevation of the portable head of FIG. 4.
Figure 10:
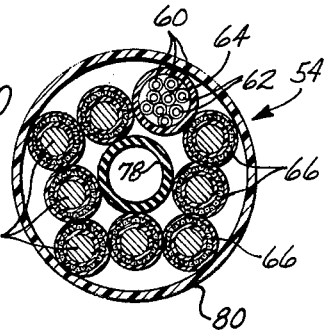
FIG. 10 is a sectional view taken along line 10—10 of FIG. 8.

A handle 40 is mounted to the casing 26 with mounting bolts 42. Openings 44 in the handle are located to provide hand holds, switch 46 with push button 48 acts as a firing pin for initiating a pulling cycle, and a dial on a variable adjustment control 50 is also located on the handle. In FIGS. 4 through 6 a pair of adjustable controls **50*a* and 50*b* are used. One to be used to control the amplitude of the slow pulse current, and the other to be used to control the amplitude of the fast pulse current. In dent pulling, it is especially advantageous to have a separate control for each capacitor as the size of the dents vary; and one may also wish to change the relationship between the amplitudes of the two pulses of current with succeeding steps when a dent is pulled in several steps. However, a single adjustable control may be used for pulling when the ratio of amplitude between the two pulses need not be varied. A member 52, integral to the casing 26, acts as half of a clamp for fastening a cable 54 to the casing with the other half of the clamp 56 being secured with bolts 58. The cable extends from control panel 10 and has a plurality of insulated conductors 60 and a pair of insulated conductors 62 inside a sheathing 64. The conductors 60 are to transmit control signals between the adjustable controls 50***a* and 50*b*, and the logic system 18 in the control box 10. The conductors 62 are to transmit control signals between the firing pin 48 and the logic system. A plurality of coaxial cables 66 which in this embodiment shows 8 cables are used to transmit current flow between the slow pulse and fast pulse capacitors 20 and 22 and the flux concentrator 24. The plurality of coaxial cables makes it possible to have flexibility in the cable 54 while transmitting a high current flow. Each of the center conductors 68 of the coaxial cable 66 is joined to a flexible conductor 70 which in this case is braided copper. The conductor ends may be joined to the flexible conductor by any known means such as soldering. The other end of the braided conductor is fastened by nut 72 to terminal 74 which in turn is joined to socket 38. The braided conductor 76 part of coaxial cables 66 are stripped near the ends, joined together and extend under nut 72*a* which fastens those braided conductors to terminal 74*a* which in turn is joined to socket 38*a*. Cable 54 also encloses flexible pneumatic hose 78 and has an insulative sheathing 80 covering the cable. This flexible hose fastens over tubing 82 which extends down to opening 30 in the casing 28 for the flux concentrator 24. The hose 78 is connected to a source of compressed air, not shown, which forces air as required through the passage 34 to cool the flux concentrator.

While preferred embodiments of the invention have been illustrated and described, it will be appreciated that various changes can be made without departing from the spirit and scope of the invention.

We claim:

1. A portable head for electromagnetic pulling of conductive materials wherein a flux concentrator first receives a slow rise high amplitude electrical current from a control panel followed by a fast rise lower amplitude electrical current flowing in the opposite direction to generate an attracting fore between the flux concentrator and the conductive material, and the portable head comprises: a snout having a flux concentrator, a handle for the snout having a dial to control amplitude of electrical currents to flow to the flux concentrators from capacitors and a cycle initiating firing button, means for transmitting control signals from the amplitude control dial and from the cycle initiating firing button in the handle to a control panel and means for transmitting a controlled signal from the control panel to the flux concentrator in the snout and the means for transmitting the signals includes a multi-conductor flexible cable and further comprising a flexible conductor inside the snout joined to multi-conductor ends of the flexible cable and then to terminals leading to the flux concentrator.

2. A portable head as in claim 1 wherein the flexible conductor is braided.

3. A portable head as in claim 1 wherein the flux concentrator is a separate part embedded in a non-conductive material and having a pair of projecting connectors to plug into the snout to permit ready exchange of the concentrator.

4. A portable head for electromagnetic pulling of conductive material comprising:

a snout having a flux concentrator, a handle for the snout having a dial to control amplitude of electrical current to flow to the flux concentrator and a cycle initiating firing button, means for transmitting control signals from the cycle initiating firing button in the handle to a control panel and for transmitting a controlled signal from the control panel to the flux concentrator in the snout, the means for transmitting the signals include a flexible cable the snout has a series of adjoining passages to permit airflow through to cool the flux concentrator, and means to include a hose within the flexible cable for introducing compressed air to the passages.

5. A portable head for electromagnetic pulling of conductive material comprising:

a snout having a flux concentrator, a handle for the snout having a dial to control amplitude of electrical current to flow to the flux concentrator and a cycle initiating firing button, means for transmitting control signals from the cycle initiating firing button in the handle to a control panel and for transmitting a controlled signal from the control panel to the flux concentrator in the snout, the flux concentrator is a separate part embedded in a non-conductive material having a pair of projecting connectors to plug into the snout to permit ready exchange of the concentrator, the flux concentrator has a series of air passages, the snout has at least one air passage leading to the passages in the flux concentrator, and means for introducing air to the passage in the snout to cool the flux concentrator.

6. A portable head for electromagnetic pulling of a conductive material wherein a flux concentrator first receives a slow rise high amplitude electrical current from a control panel followed by a fast rise lower amplitude electrical current flowing in the opposite direction to generate an attracting force between the flux concentrator and the conductive material, and the portable head comprises: a non-conductive casing having a flux concentrator, a handle for the casing having mounted thereon an adjustable regulator to control current amplitude and a firing pin to initiate a pulling cycle, a flexible cable fastened to the casing and having a plurality of conductors leading from a control panel to transmit control signals from the cycle initiating firing pin and from the adjustable regulator to the control panel and to transmit controlled signals from the control panel to the flux concentrator, a series of passages in the casing located to pass cooling air around the flux concentrator, and a hose within the flexible cable for introducing cooling air to the passages in the casing.

7. A portable head for electromagnetic pulling of a conductive material wherein a flux concentrator first receives a slow rise high amplitude electrical current from a control panel followed by a fast rise lower amplitude electrical current to generate an attracting force between the flux concentrator and the conductive material, and the portable head comprises; a non-conductive casing, a handle for the casing, at least one adjustable regulator on the handle to control current amplitude, a firing pin on the handle to initiate a pulling cycle, a multi-conductor flexible cable joined to the casing and leading to a control panel to transmit control signals from the adjustable regulator and from the firing pin to the control and to transmit back controlled signals from the control panel, a flux concentrator detachably joined to the casing and located to impart a pulling force to a conductive material in response to the controlled signals initiated by the firing pin, a series of passages located in the flux concentrator, and means to include a hose within the flexible cable for delivering cooling air to the passages.

* * * * *